US008572911B1

(12) United States Patent
Binienda

(10) Patent No.: US 8,572,911 B1
(45) Date of Patent: Nov. 5, 2013

(54) INFLATABLE STRUCTURE WITH INTERNAL SUPPORT

(75) Inventor: Wieslaw K. Binienda, Akron, OH (US)

(73) Assignee: University of Akron Research Foundation, Akron, OH (US)

( * ) Notice: Subject to any disclaimer, the term of this patent is extended or adjusted under 35 U.S.C. 154(b) by 1481 days.

(21) Appl. No.: 11/707,216

(22) Filed: Feb. 13, 2007

Related U.S. Application Data

(60) Provisional application No. 60/772,808, filed on Feb. 13, 2006.

(51) Int. Cl.
*E06B 3/26* (2006.01)

(52) U.S. Cl.
USPC ..... 52/202; 52/2.11; 52/2.14; 52/2.25; 52/2.22; 52/2.16; 49/477.1

(58) Field of Classification Search
USPC ..... 52/202, 203, 2.11, 2.13, 2.14, 2.18, 52/2.19, 2.24, 2.25, 167.1, 2.17, 2.22, 52/2.16, DIG. 12; 49/477.1
See application file for complete search history.

(56) References Cited

U.S. PATENT DOCUMENTS

| | | | | | |
|---|---|---|---|---|---|
| 2,028,060 | A * | 1/1936 | Gilbert | 47/32.5 |
| 3,548,904 | A * | 12/1970 | Mackell | 53/473 |
| 3,854,253 | A * | 12/1974 | Slowbe | 52/2.15 |
| 3,936,984 | A | 2/1976 | Yando | |
| 3,945,156 | A | 3/1976 | Hamm | |
| 4,027,437 | A | 6/1977 | Monsky et al. | |
| 4,040,210 | A * | 8/1977 | Land | 52/2.12 |
| 4,098,035 | A * | 7/1978 | Bessler | 52/2.12 |
| 4,156,330 | A | 5/1979 | Fraioli | |
| 4,478,012 | A | 10/1984 | Fraioli | |
| 4,631,873 | A | 12/1986 | Parish | |
| 4,675,060 | A * | 6/1987 | Schnebly et al. | 156/65 |
| 4,805,355 | A | 2/1989 | Plant | |
| 4,807,405 | A | 2/1989 | Borgquist | |
| 4,924,651 | A | 5/1990 | Plant | |
| 5,305,561 | A | 4/1994 | Goddard | |
| 5,493,816 | A | 2/1996 | Willemsen | |
| 5,608,992 | A * | 3/1997 | Floyd | 52/3 |
| 5,815,991 | A | 10/1998 | deRidder | |
| 5,937,595 | A * | 8/1999 | Miller | 52/202 |
| 6,061,969 | A | 5/2000 | Leary | |
| 6,070,366 | A | 6/2000 | Pierson | |
| 6,453,619 | B1 | 9/2002 | Delamare | |
| 6,740,381 | B2 | 5/2004 | Day et al. | |
| 6,877,286 | B2 * | 4/2005 | Johnson | 52/202 |
| 6,898,907 | B2 | 5/2005 | Diamond | |
| 7,464,506 | B2 * | 12/2008 | Atkinson | 52/202 |
| 7,963,075 | B2 * | 6/2011 | Howland | 52/202 |

* cited by examiner

*Primary Examiner* — Chi Q Nguyen
(74) *Attorney, Agent, or Firm* — Alvin T. Rockhill

(57) ABSTRACT

The subject invention relates to a protective window covering system comprising a conventional building window having a window frame and an inflatable protective window covering, wherein multiple hooks are mounted around the perimeter of the window frame, wherein the inflatable protective window covering is comprised of a single, uninterrupted inner cavity and walls wherein the walls of the protective covering enclose the inner space of the protective covering, and wherein the walls of the protective covering include at least two rows of fibers extending throughout at an angle that is offset by 15° to 75°, and a securing means wherein the securing means attaches loosely to the window frame in an uninflated state, wherein inflation of the protective covering applies tension to the securing mechanism thereby securing the protective covering.

11 Claims, 11 Drawing Sheets

INFLATABLE STRUCTURE WITH INTERNAL SUPPORT

This application claims the benefit of U.S. Provisional Patent Application Ser. No. 60/772,808, filed on Feb. 13, 2006. The teachings of U.S. Provisional Patent Application Ser. No. 60/772,808 are incorporated by reference herein in their entirety.

BACKGROUND OF THE INVENTION

Today for a variety of reasons there is a need for buildings that can be rapidly constructed and easily transported. Such structures are frequently inflated with air to form the desired structure. Such inflatable structures offer the advantage of being capable of being erected in a matter of hours as compared to the weeks or months that it typically takes to construct permanent frame buildings. In their uninflated state such structures are light and compact which makes them easily transportable. This is of great benefit to campers and to the military. Inflatable structures are also of benefit in applications where the structure is only needed during certain seasons of the year. For instance, inflatable structures can be used over the winter months for storing boats, jet skis, tractors, farm implements, and other equipment that it is desirable to protect from the elements during the winter. Inflatable structures offer the advantage of being deflatable so that they can be quickly and easily removed during periods when they are not needed. Inflatable buildings of this type are used to enclose recreational facilities for use in the winter time. Swimming pools and tennis courts are two examples of such facilities which are commonly converted for winter use by the erection of an inflatable building. Naturally, such buildings must be heated and this is done by heating the air that is pumped into the building to maintain its interior pressure. Most of these recreational structures are used only in the winter. In the spring, they are deflated, taken apart, and placed in storage.

Inflatable buildings have not come into widespread use because they are not generally as durable as permanent frame buildings. This is because inflatable structures can generally be easily damaged by acts of nature, accidents, and even intentional acts of maliciousness. For instance, inflatable buildings generally do not have the structural strength to withstand high winds such as those that might be encountered during a tropical storm or a hurricane. The buildup of ice and snow on such structures can also prove to be problematic by virtue of putting more weight on the structure than it is capable of withstanding. Inflatable buildings are also more susceptible to mechanical damage by impact from debris, such as tree limbs, which can in worst case scenarios rupture the inflatable structure causing it to deflate. Unfortunately, inflatable buildings that are supported solely by air pressure are also attractive targets for vandals because catastrophic damage can be inflicted using minimal effort.

Another disadvantage that is currently limiting what would otherwise be an even more widespread use of inflatable structures is the fact that such structures are notoriously ineffective in restraining heat transmission into and out of the thus enclosed space. This is basically due to the fact that a space enclosed by such inflatable structures is separated from the ambient environment only by a thin wall of the inflated structure. The consequent, inordinately high heat transmission co-efficient for the structure makes the heating and air-conditioning of the enclosed space both difficult and very expensive. Troublesome condensation also arises when the moist, warm interior air contacts the cold, thin wall of the air structure. These factors negate much, if not all, of the economic advantages of utilizing such a structure in those many cases where heating or air-conditioning is a requirement.

There also exists a need for a light weight and reusable inflatable protective covering for conventional windows that is easy to use and easy to store. High winds and flying debris associated with severe storms, tornadoes, and hurricanes often cause glass windows to break, sending shattered glass indoors and allowing the wind, rain and flying debris to then damage the interior of the building. Protection of glass windows in buildings during storms is a common problem and a variety of methods have been employed to prevent windows from breaking under such conditions. Prior art methods for protecting glass windows in buildings from storm damage include prefabricated storm shutters, plywood sheets, lamination systems, taping, and compressible structures.

Prefabricated storm shutters are designed to fit the exact dimensions of a window and typically provide adequate protection from flying debris and high winds. However, prefabricated storm shutters are expensive, and also require substantial time for construction meaning they would not be available unless ordered well in advance of the storm. Plywood sheets also may offer adequate protection for windows, but the sheets must be cut to the proper size and require screwing into the building to secure the plywood sheet over the window. Plywood sheets are heavy which makes installation difficult, and in some cases impossible, for homeowners such as the elderly. Also, the plywood sheets must either be stored after a storm until they are needed again, or disposed of in some way which then requires purchasing new plywood sheets upon the occurrence of another severe storm, tornado or hurricane. Lamination systems are designed to prevent broken glass from collapsing into the building, however the lamination systems are not effective at preventing a glass window from shattering. Similarly, taping does not protect a glass window from shattering but instead only prevents the shattered glass from collapsing into the building. Compressible structures have been developed for temporary positioning over a glass pane during a storm wherein a shaping member is filled with a fluidic compressible material which dries or cures to form a layer of solidified compressible material. Such a compressible structure requires considerable storage space after being used for the first time, and the compressible material may also be expensive and difficult to find.

U.S. Pat. Nos. 4,805,355 and 4,924,651 describe an inflatable building structure erectable in situ for housing plants comprising a plurality of vertically oriented support posts arranged in two or more spaced parallel rows thereof, the outer rows of which define opposite sides of the building structure; a roof structure formed from one or more inflatable membranes attached to and standing between two spaced parallel rows of support posts and constituting the roof of the building structure; elevating means including cables connected to the tops of the posts of said two rows thereof for raising said one or more inflatable membranes in an uninflated condition to a position supported on the tops of said posts and providing upper and lower support cables for roof members when inflated; one or more side curtains associated with the outer rows of said support posts and extending substantially from the top of the posts to adjacent ground level; actuating means for selectively raising or lowering the lower end of said one or more side curtains; thermostat control means for operating said actuating means to raise or lower the bottom end of said one or more curtains in response to temperature variations from a selected temperature in order to maintain the temperature of the interior of the building structure at the selected temperature; said actuating means including a support rail attached to an adjacent vertically oriented support post; a carriage member for reciprocatable movement along the support rail; a support rod for supporting at least one of said side curtains in the course of its raising and lowering movement; a motor assembly mounted in the support rail; and gear means interconnecting the motor assembly and said support rod for said one side curtain.

U.S. Pat. No. 4,027,437 also describes an inflatable building which relies upon a support frame for internal support. U.S. Pat. No. 4,027,437 more specifically describes a building comprising: (a) support frame means including a plurality of spaced-apart upright first frame means having their lower ends anchored to base means and having their upper ends interconnected to a grid formed of plural spaced-apart second frame members; (b) first and second manifold means mounted adjacent to the periphery of said support frame means and each having an inlet and plural outlets, with their inlets being respectively fluid-connected to a source of pressurized fluid through separate first and second control valve means and with the plural outlets of said first manifold means being offset from the plural outlets of the second manifold means; and (c) covering means for covering said support frame means including two groups of plural inflatable hollow tubular members which extend across said frame means generally parallel to one another, with all members of a first group of said two groups being substantially opaque about their entire tubular peripheries and fluid-connected to the outlets of said first manifold means and all members of a second group of said two groups being substantially translucent and fluid-connected to the outlets of said second manifold means and with one member of each of said groups being located contiguous to one member of the other of said groups such that the amount of light that can be transmitted through said covering means can be selectively varied through operation of said valve means.

U.S. Pat. No. 6,070,366 discloses an air supported shelter that is provided with stability by a series of vertical, rigid posts and angled braces. U.S. Pat. No. 6,070,366 more specifically discloses an air supported enclosure having its lower peripheral edges attached to a base, comprising: a flexible cover envelope comprising elongated flexible sheets arranged in parallel adjacent relationship to each other to cover the entire area to be enclosed; a pair of parallel spaced apart flexible elongated reinforcing members positioned loosely against an inside surface of each sheet; each reinforcing member being positioned laterally inwardly a spaced distance from a corresponding side edge of the sheet so that a center portion of each sheet lies between the pair of reinforcing members and an excess width portion of each side edge of the sheet extends over and downwardly below the respective reinforcing member to form a loosely hanging substantially vertical flap throughout the entire width of the flap; each sheet being positioned against an adjacent sheet with each loosely hanging substantially vertical flap in intimate contact with an adjacent loosely hanging substantially vertical flap and the respective reinforcing members at each pair of adjacent flaps being in close proximity to each other separated by the two adjacent flaps; retaining means fastening together each pair of adjacent reinforcing members at spaced intervals along the length thereof to form elongated closures between the adjacent sheets and hold each pair of adjacent flaps in contact with each other when air inflation pressure is introduced into the enclosure; each end of the sheets and the reinforcing members being sealingly attached to a periphery of the base to form an airtight enclosure over the base; and means supplying internal inflation pressure to the interior of the enclosure in excess of atmospheric pressure; the internal pressure forcing together adjacent surfaces of each adjacent pair of loosely hanging substantially vertical flaps to seal the elongated closures between adjacent sheets.

U.S. Pat. No. 3,936,984 and U.S. Pat. No. 4,156,330 also disclose inflatable structures that are supported by air pressure being pumped into the interior of the structure. U.S. Pat. No. 3,936,984 discloses an air inflated shell-like structure for enclosing a volume of space therein, said structure having insulated walls which curtail heat flow from or into said enclosed volume, comprising: a flexible outer skin defining the exterior shell of said structure; means for providing positive air pressure within said enclosed volume of said structure for maintaining said skin in a fully expanded condition, the geometry of said skin being such that in said expanded condition, concavities are formed by said skin defining said shell wall; and a thin plastic film secured at the outer surface boundaries of said concavity, and secured to the shell wall within said boundary, said thin film being continuous across said boundary and the surface area of the film being less than surface of said concavity within said boundary, the space between said outer skin and thin plastic film communicating by openings in said plastic film with the said enclosed volume of said structure and being at the pressure of said enclosed volume, whereby said flexible outer skin is expanded by said positive pressure in said enclosed volume, whereby in the inflated structure, the said film is extended in taut fashion across the concavity to define an insulating air space between wall and film. U.S. Pat. No. 4,156,330 discloses a double-wall fabric panel unit having interior and exterior sides for use as wall sections in the construction of inflatable buildings, comprising, in combination, a first elongated panel of fabric, and an elongated thermal liner panel having an edge strip extending along each side edge thereof attached to the face of said first panel which is in the interior of the building, each of said side edge strips being discontinuous at intervals along the length of said liner panel to provide a plurality of spaced unobstructed air passageways to the atmosphere to vent air from between said panels when said unit is rolled.

U.S. Pat. No. 5,815,991 also discloses an inflatable building which is particularly suitable for utilization as a greenhouse that is supported by air pressure within the structure of the building relative to the pressure of the atmosphere outside of the building. U.S. Pat. No. 5,815,991 more specifically discloses an inflatable building construction, in particular suitable for use as a tunnel greenhouse comprising a film, said film being kept in an operative condition doming a predetermined useful space through an air pressure that has been increased relative to the environment, said film having longitudinal edges anchored in a substantially open trench said building construction further including at least one expandable hose or tube laying in the trench and engaging the longitudinal edge of said film in the trench said hose or tube being filled with fluid under pressure, thereby pressing the longitudinal edge of said film against at least one wall of the trench and firmly retaining the film edges in the trench.

U.S. Pat. No. 3,945,156 discloses a building construction including a lattice-like network of support elements connected together at junctures to form a three-dimensional frame for the support of a fabric-like canopy laid thereover as an enclosure which is secured along its bottom edge, a plurality of hollow and resilient ball-like buffers, each of which is supported by the frame at a point of juncture of some of said support elements to engage the canopy and thereby to prevent the said canopy from direct engagement with the frame, particularly at the said juncture point, and at least one of the support elements at each juncture of such elements comprising a conduit connected to the buffer at the juncture point and also connected with a source of gas under pressure whereby all of said buffers are gas filled at the pressure of said source.

U.S. Pat. No. 4,807,405 relates to an inflatable structure that relies upon inflatable tubular ribs for structural support. U.S. Pat. No. 4,807,405 more specifically discloses an inflatable structure, comprising: a plurality of inflatable rib members arranged in a lattice-like framework; a plurality of inflatable panel members, each said panel member being supported within a frame section defined by a plurality of said inflatable rib members; valve means communicating with said rib members and said panel members for supplying a substance under pressure to inflation chambers defined within said rib members and said panel members; and said inflatable structure being dome-shaped in its inflate state; each said frame section supporting each said panel member is defined by three of said inflatable rib members arranged in a substantially equilateral triangle configuration; and said inflatable structure has a geodesic dome shape in its inflated state; each said rib member is substantially tubular; and each said panel member is formed of at least an inner and an outer ply of material having said inflation chamber defined therebetween; said panel members are affixed to said rib members by seam portions; and conduits are provided in said seam portions to permit communication between said inflation chambers of said rib members and said inflation chambers of said panel members; said plurality of inflatable rib members have the inflation chambers thereof intercommunicating so as to define a plurality of inflation sections of said inflatable structure; and each said inflation section of said inflatable structure is provided with at least one said valve means; each said substantially tubular rib member is formed with a central ply of material extending transversely therethrough; each said panel member is formed with a central ply of material extending transversely therethrough in substantially coplanar relation to said central ply of said rib members; and said central plies are provided with perforations to permit flow of said substance under pressure therethrough; and an external ply of material extends over at least a plurality of said frame sections.

U.S. Pat. No. 6,453,619 discloses an inflatable building that relies upon inflatable beams for structural support. This patent more specifically relates to a canopy, which can be inflated and deployed by inflation, and retracted by deflation, said canopy comprising: a plurality of inflatable beams arranged side by side, said inflatable beams each having an inner space and walls, said plurality including an upper inflatable beam and a lower inflatable beam; a pressurized-fluid-supplier operable to supply said inflatable beams with pressurized fluid; a rigid beam having a wall; sliding means for sliding said inflatable beams along at least one deployment or refolding path formed by said rigid beam passing, in a leak-tight manner, through said inflatable beams and forming a fluid-conveying channel linked to said pressurized-fluid supplier; at least one orifice in said wall of said rigid beam, placing said pressurized-fluid supplier in communication with said inner space of said inflatable beams; linking means for leaktight linking of adjacent walls of said inflatable beams around said rigid beam; spacing means, around said rigid beam, for spacing said walls of said upper inflatable beam from one another; at least one bearing element bearing against said inflatable beams; and positioning means for successive positioning of said inner space of each inflatable beam, said positioning means being opposite said orifice of said rigid beam to guarantee inflation of said inflatable beams, by the pressurized fluid, from said upper inflatable beam to said lower inflatable beam and deflation of said inflatable beams from said lower inflatable beam to said upper inflatable beam.

U.S. Pat. No. 4,631,873 discloses an inflatable structure having a plurality of sections wherein each section has a series of inflatable arched tubes that are arranged parallel to each other and in successive tangential abutting contact. This patent more specifically discloses an inflatable shelter having at least two separate sections, each section having a series of inflatable arched tubes arranged transversely of said section, adjacent ones of said tubes in each section are interconnected, means interconnecting adjacent sections each of said sections having a roof cover sheet overlying the tubes in their respective sections, each of said covers has means for securing the section it overlies to an adjacent section, and anchoring means connected to said cover sheets for anchoring said cover sheets and sections to the ground supporting said inflatable shelter.

U.S. Pat. No. 4,478,012 relates to a cabling system to improve the ability of an inflatable building to withstand wind. This patent more specifically discloses a cabling system for reinforcement of an inflatable building structure comprising a latticework of crisscrossed cables arranged to extend over the entire building with substantially all of the cables which meet a lower peripheral edge of the structure being arranged diagonally at a uniform angle of substantially less than ninety degrees to that edge and with substantially all of said cables which meet a lower peripheral edge being paired with and meeting an opposite diagonally extending cable at said peripheral edge, the members of each of said pairs of diagonally opposite extending cables being formed from one continuous cable extending down on one diagonal to the edge and turning back up on the other diagonal, anchoring means to hold said continuous cable at the turn between diagonals, said anchoring means comprising a sheave arranged to permit an adjustment in length between the associated diagonal cables wherein one diagonal cable becomes longer and the other diagonal cable becomes shorter.

U.S. Pat. No. 5,305,561 describes the utility of utilizing an inflatable structure as a floating boat house and U.S. Pat. No. 6,061,969 describes the utilization of a dome-shaped inflatable structure as a greenhouse. U.S. Pat. No. 5,493,816 describes an inflatable building block with collapsible sides and with coupling means on the upper and lower faces which allow the blocks to be interconnected to form structures.

U.S. Pat. No. 6,740,381 describes fiber reinforced composite cores and panels formed from a plastic foam material having elongated porous and fibrous webs and/or rovings extending through the foam material. U.S. Pat. No. 6,740,381 more specifically discloses a fiber reinforced core adapted for infusion with a hardenable resin and having opposite core surfaces adapted to be attached to corresponding skins, said core comprising plastics foam material forming said core surfaces, a plurality of rows of reinforcing struts extending between said opposite core surfaces, each of said struts comprising porous and fibrous rovings enclosed by said foam material, and said struts having cut and flared end portions overlying at least one of said core surfaces.

U.S. Pat. No. 6,898,907 describes structures positioned over glass panes to absorb forces from high winds and wind-borne debris to protect the glass panes from shattering and damage. More specifically, U.S. Pat. No. 6,898,907 discloses a protected window structure comprising a window structure including a frame circumscribing an area containing exposed glass having an exterior facing side; a shaping member removably secured on said window structure and defining a cavity over said exterior facing side of said glass; a body of solidified compressible material in said cavity of a size to cover said area circumscribed by said from at least substantially in its entirety to provide protection for said glass, said compressible material being supplied to said cavity in a fluidic form and solidifying in said cavity; and a port in said shaping member communicating with said cavity by which said compressible material is supplied to said cavity in said fluidic form.

SUMMARY OF THE INVENTION

The present invention relates to an inflatable structure that is light and compact in its uninflated state for ease of transportation. It also can be quickly and easily inflated into a rigid structure at a desired location. The inflatable structure of this invention offers an advantage over structures that are described in the prior art in that it does not require rigid internal supports, such as wood or metal poles or beams and in one embodiment the walls thereof can be filled with a polymeric foam to provide rigidity and thermal insulation. In one embodiment of this invention the inflatable structure is filled with air or a liquid, such as water, which allows for the structure to be easily deflated into a compact state to facilitate transportation to another location. In still another embodiment of this invention the inflatable structure can be filled with a material that will cure into a permanent rigid structure.

The subject invention more specifically discloses an inflatable structure that can be inflated and deployed by being pressurized with a fluid, said inflatable structure comprising: a plurality of cell members having an inner space and walls, wherein the walls of the cell members enclose the inner space within the cell members, wherein the walls of the cell members include at least two rows of fibers wherein the rows of fibers extend through the walls of the cell members at an angle that is offset by 15° to 75°, wherein the plurality of cell members are affixed together to provide the desired shape of the inflatable structure, and wherein there is at least one orifice in each cell member through which said fluid can be added to inflate the inflatable structure into the desired shape.

The present invention also reveals an inflatable protective structure for conventional buildings having exterior walls, said inflatable protective structure comprising a plurality of cell members having an inner space and walls, wherein the walls of the cell members enclose the inner space within the cell members, wherein the walls of the cell members include at least two rows of fibers wherein the rows of fibers extend through the walls of the cell members at an angle that is offset by 15° to 75°, wherein the plurality of cell members are affixed together to extend around the perimeter of the conventional building in a trough in their un-inflated state, wherein the plurality of cell members are affixed together cover at least one exterior surface of the conventional building in their inflated state, and wherein there is at least one orifice in each cell member through which said fluid can be added to inflate the inflatable structure into the desired shape.

The present invention further reveals an inflatable protective covering for a conventional building window comprising an inner cavity and walls wherein the walls of the protective covering enclose the inner space of the protective covering, and wherein the walls of the protective covering include at least two rows of fibers extending throughout at an angle that is offset by 15° to 75°, an inflation orifice wherein the inflation orifice operates to allow inflation of the protective covering with air, and a securing means wherein the securing means attaches loosely to the window frame in an uninflated state and wherein inflation of the protective covering applies tension to the securing mechanism thereby securing the protective covering in position.

DETAILED DESCRIPTION OF THE INVENTION

Figure 1:
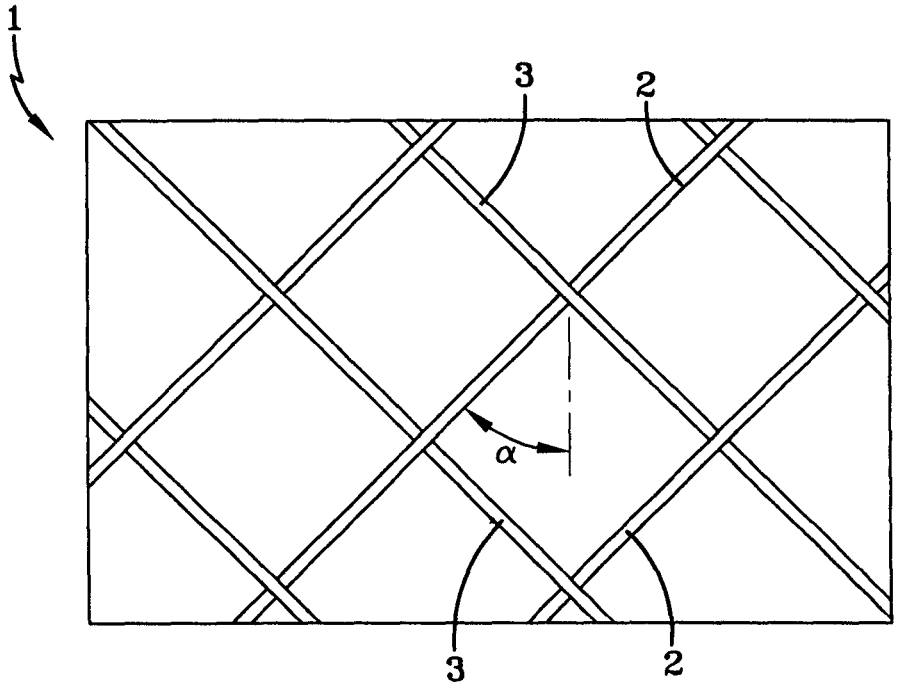
FIG. 1 is a schematic side view of a rectangular shaped cell member.
Figure 2:
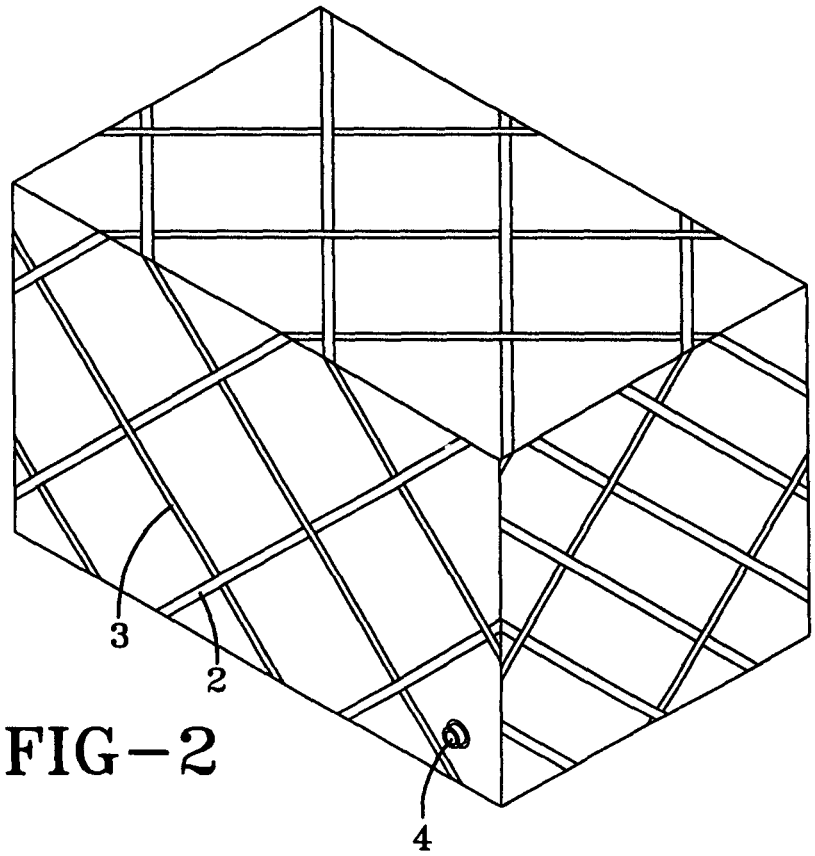
FIG. 2 is a perspective view of a rectangular shaped cell member.
Figure 4:
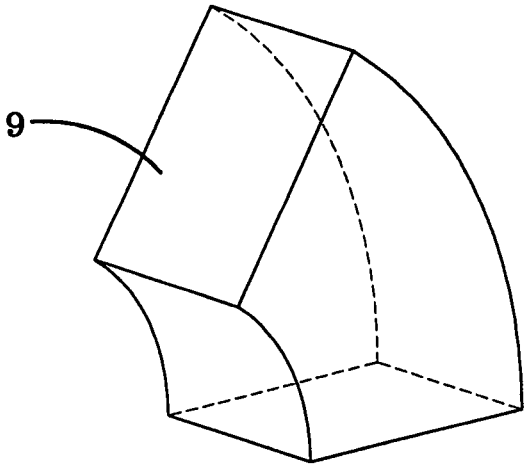
FIG. 4 is a perspective view of an arched cell member.

The inflatable structures of this invention are comprised of a plurality of cell members having an inner space and walls. These cell members can be of any desired geometric structure. For instance, the cell members can be cubes, rectangular blocks, arched blocks, or cylindrical. A cell member in the form of a rectangular block is shown in FIG. 1 and FIG. 2. A cell member in the form of an arched block is depicted in FIG. 4. The inner space within each cell member is enclosed by one or more walls of the inflatable structure. The inner space within each cell member is essentially void space that can be filled with a fluid. The fluid can be a gas, such as air, a liquid, such as water, or a solid that is capable of flowing into the inner space and filling its volume. Sand is a preferred example of such a fluid solid. The inflatable structure can also be inflated by pumping uncured concrete into the inner space within the walls of the cell members. Concrete offers the advantage of resulting in a strong heavy structure that is highly resistant to wind and other environmental elements. However, inflatable structures that are inflated with concrete have the disadvantage of not being capable of being deflated for transportation to other locations.

In some applications it is desirable to inflate the structure with chemical agents that produce foam to inflate the structure. Depending upon the chemical agent used, the foam can be rigid and strong which provides additional reinforcement for the structure. In other cases, the foam is more flexible but still serves to keep the structure properly inflated. In either case the foam within the individual cell members greatly improves the insulating capacity of the structure. This is particularly desirable in cases where the permanent structure will be used in harsh environments, such as extremely hot or extremely cold environments. Since the foam produced is filled to a very high extent with a gas, the chemicals needed to produce a very large volume of foam are relatively light and compact. This allows for such chemicals to normally be easily transported to the ultimate location where the structure will be erected. A number of different types of chemical agents are suitable for utilization in inflating the structures of this invention with foam.

The inflatable structure can be inflated with a polyurethane foam by injecting a disocyanate and a polyethylene glycol into the void space of the cell members. To produce a foam structure a blowing agent, such as acetone or methylene chloride, will also be injected into the cell members with the diisocyanate and the polyethylene glycol. The desired cell structure and density can be attained by controlling the amount of blowing agent used. A catalyst can also be included to accelerate the reaction and to control the formation of foam cell structure. A small amount of water can optionally be added in place of the blowing agent to produce a foam structure. The presence of water produces foam because it reacts with the isocyanate to generate bubbles of carbon dioxide which produces a cell structure that hardens as the polymerization reaction between the diisocyanate and the polyethylene glycol proceeds.

The walls of the cell members will typically be made from a flexible plastic, an elastomer, or a thermoplastic elastomer. However, the walls of the cell member can also be comprised of a fabric which is essentially impermeable to the fluid that is contemplated for use in filling the inner space of the cell members to inflate the inflatable structure. In cases where air is contemplated for use as the fluid the walls will typically be made of a material that is impermeable to air. On the other hand, if it is contemplated that the inflatable structure will be inflated by filling the cell members with water the material of which the cell member walls are comprised should be watertight. In scenarios where it is contemplated that the inner space within the walls of the cell members will be filled with a fluid solid such as sand, it is not necessary for the cell walls to be either air or watertight. However, it is important for the cell walls to be capable of retaining the fluid solid. In many cases, it will be desirable for the walls of the cell members to be made of a material which is capable of holding any gas, liquid, or fluid solid that could potentially be used for inflating the inflatable structure. The utilization of such materials offers flexibility in that the user of the inflatable structure has the flexibility to inflate the structure with the fluid that is most suitable for the desired application and which is readily available at the desired location for the inflatable building.

The walls of the cell members will typically have a thickness of about 0.002 inches to about 0.1 inches and will preferably have a wall thickness of 0.002 inches to 0.05 inches and most preferably from 0.005 to 0.01 inches. The walls will typically be comprised of a polymeric material such as a tough flexible plastic or a rubbery polymer. Some representative examples of suitable plastics include, but are not limited to, polyethylene, polypropylene, nylon, polyurethane, polyvinyl chloride, polyesters, and the like. The wall can also be comprised of a woven nylon or polyester cloth that is impregnated with a vinyl polymer. Suitable rubbery polymers that can be used include, but are not limited to, natural rubber, synthetic polyisoprene rubber, polybutadiene rubber, styrene-butadiene rubber (SBR), styrene-isoprene rubber, ethylene-propylene-diene rubber (EPDM), chloro-butyl rubber, nitrile rubber, and the like. Since halobutyl rubbers exhibit very low permeability to gases it is frequently desirable for the walls of the cell members to be made of a halobutyl rubber or a rubber blend containing a halobutyl rubber. In cases where the structure will be inflated with air it is desirable for the walls of the cell members to be comprised of multiple layers wherein at least one of the layers is comprised of a halobutyl rubber, such as a bromobutyl rubber or a chlorobutyl rubber.

The walls of the cell members employed in the inflatable structures of this invention are reinforced with a fiber reinforcement. The fiber reinforcement will be incorporated into the cell walls in at least two rows wherein the rows are offset from each other at an angle which is within the range 15° to 75°. The rows of fibers will more commonly be offset to each other by an angle of 30° to 60°. It is typically preferred for the rows of fibers to be offset by an angle which is within the range of 40° to 50° with an offset angle of about 45° being most preferred.

FIG. 1 is a schematic side view of a rectangular cell member of the subject invention. The rectangular cell structure 1 is reinforced with two rows of reinforcing fibers. The first group of rows of fibers 2 is offset from the second group of rows of fibers 3 by an offset angle $\alpha$. The offset angle $\alpha$ shown in FIG. 1 is approximately 45°. An offset angle of 45° is highly preferred in order to attain the highest level of reinforcement. However, the offset angle can differ from 45° if desired to attain specific design characteristics without departing from the scope of the present invention. FIG. 2 is a perspective view of such a rectangular cell member having an external check value 4 on the face thereof.

The fibers used in reinforcing the cell member walls can be made from a wide variety of materials. The fibers used will be chosen according to the ultimate performance characteristics that are sought. Another criterion to consider in selecting the fibers is cost. The fiber can be comprised of a metal, a polymer, an inorganic fiber, or a plant fiber. The fiber can be a glass fiber which is desirable to use from a standpoint of being typically of relatively low cost. Glass fibers are generally accepted in typical applications that do not demand high structural integrity. In higher performance applications the fiber used to reinforce the cell members of the inflatable structure can be high strength carbon fibers or Kevlar® polyparaphenylene terephthalamide fibers. The utilization of such high strength fibers is beneficial in larger structures which demand higher levels of strength simply by virtue of their greater size. High strength fibers are also employed advantageously in applications where the inflatable structure will be inflated with a dense material such as sand or concrete.

The cell members of the inflatable structure will each contain at least one orifice through which the cell member can be inflated with the fluid that is used to inflate the structure. The orifice will be of a design and size that is appropriate with respect to the overall size and design of the cell member and the fluid that it is contemplated will be used to inflate the cell member. Generally, larger cell members require a larger size orifice through which the fluid can be introduced to inflate the cell member. In some cases, it is advantageous for the cell members to be inflated directly through the orifice of the cell member. In this scenario the orifice of the cell member will be positioned in a manner whereby the fluid can be introduced into the cell member from a position external to the structure. Cell members having orifices on external surfaces of the inflatable structure will include a means for closing the orifice to prevent loss of the fluid used to inflate the structure. For instance, the orifice could be sealed with a snap-on cap, a threaded cap, a check valve, or a zipper. The means used to seal the orifice will be selected to be appropriate with the overall design of the inflatable structure with the fluid used to inflate the structure being kept in mind. In cases where the structure is filled with air or a liquid it is typically convenient for the orifice to be sealed with a cap or a check valve. In situations where the inflatable structure will be inflated with a solid material, such as sand or a high viscosity fluid, such as uncured concrete it is often desirable to seal the orifice with a zipper.

In inflatable structures that are inflated with gases it is frequently desirable for the orifice of one cell member to be filled with fluid that is injected into an adjacent cell member. In this situation certain cell members can have orifices for inflating the cell member that lead to another inflatable cell member. In one such scenario it is not essential for the orifice to include a closing means because the orifice does not lead to the external environment surrounding the inflatable structure. Even though such an orifice that leads to the interior of another cell member does not inhibit the flow of the fluid used to inflate the structure the cell member will not deflate by virtue of the fluid therein being at equilibrium with the fluid in the adjacent cell structure to which the orifice leads.

Figure 3:
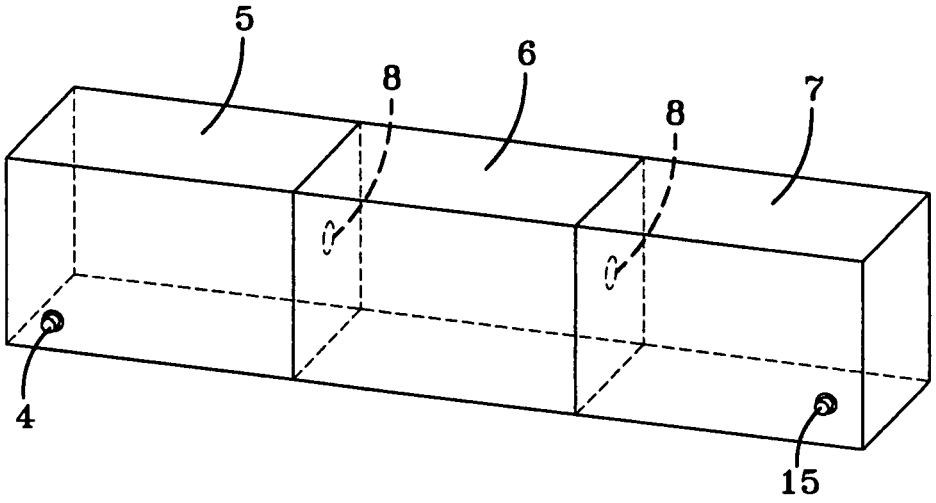
FIG. 3 is a perspective view of a group of cell members.

The orifice of such a cell member that leads to the interior of an adjacent cell member can optionally include a means by which the orifice closes after being inflated with the fluid used to inflate the structure. For example, a check valve can be used to seal the orifice after it has been inflated. This can be advantageous in situations were the adjacent cell member becomes damaged in a manner whereby it is no longer capable of retaining the inflation fluid. Such a design is particularly beneficial in structures where multiple cell members are interconnected through a series of internal orifices because the failure of a single cell member within the interconnected series will not necessarily cause all of the other cell members to deflate. However, this design does not allow for the inflatable structure to be deflated by withdrawing the fluid used to inflate the structure through the orifice used to inflate the structure. For instance the block of cell members shown in FIG. 3 can be inflated through external check valve 4. However, the fluid used to inflate the block of cell members cannot be removed through check value 4. The fluid will not move back into cell member 6 from cell member 7 through check valve 8 or back into cell member 5 from cell member 6 through check valve 8. In cases where it is desirable to have the ability to deflate such structures a deflation valve 15 can be incorporated into an exterior wall of cell member 7. The block of cell members can be deflated through deflation valve 15 since the fluid will flow from cell member 5 through check valve 8 and into cell member 6. The fluid will in turn flow from cell member 6 through check valve 8 and into cell member 7. Thus, the deflation valve 15 in the wall of cell member 7 can be used to deflate the series of cell members in block (cell members 5, 6, and 7).

In another embodiment of this invention remote control valves can be utilized to interconnect cell members through internal orifices. Remote control valves offer the advantage in that when the valves are in the closed position, the fluid can only escape from cell members that have been damaged. Since the valves will not permit fluid from adjacent cell members into the damaged cell member through which they can escape. Remote control internal valves also offer an advantage over check valves in that they can be opened at the time that it is desirable to deflate the structure with it being possible to remove the fluid used to inflate the structure through the same external orifice that was used to inflate the structure. Such remote control valves will normally be designed to open and close by radio control. These valves will be in the open position at the time that the structure is inflated or deflated and will preferably be in the closed position during times that the structure is being maintained in an inflated position.

In still another preferred embodiment of this invention a pumping means will be provided for removal of the fluid used to inflate the structure at the time it is deflated. Even though the inflatable structures of this invention can in some cases be deflated by simply opening the external orifices of external cell members the time required for the fluid used to inflate the structure can be quite long. For this reason, it is frequently desirable to provide the structure with a pumping means for removing the fluid. For instance, air and other gases can be removed from the inflatable structure with a vacuum pump to facilitate the deflation of the structure. In addition to saving time the utilization of such a means for removal of the fluid typically also makes it easier to compact the structure into a relatively flat orientation after deflation.

In manufacturing the inflatable structures of this invention the individual cell members can be affixed together to form inflatable structures having a wide variety of designs. In manufacturing such structures the individual cell members are brought together like building blocks to construct the desired structure. The individual cell members can be affixed together by a wide variety of techniques that strongly secure the cell members together in a manner that will be suitable in the particular application. For instance, the cell members can be stitched together or adhered together with a suitable adhesive that will not harm the material from which the walls of the cell structures are made. A solvent based adhesive or a hot melt adhesive can be used to adhere the cell structures together.

The inflatable structures of this invention can be a wide variety of architectural designs and sizes. These structures can be easily transported and quickly erected. This is because they are light weight and compact before being inflated. However, in one embodiment of this invention, after performing their needed function at the site of deployment they can be deflated for removal and possible reuse at another location. In such cases the inflatable structure will typically be inflated with a gas or liquid. If it is contemplated that the inflatable structure will only be used at a location for a relatively short period of time it is normally desirable to inflate the structure with a gas, such as air. However, more permanent structures can be quickly constructed by inflating the structure with sand or concrete. Concrete offers the advantage of high strength, but makes deflation of the structure for removal to another location impossible.

Figure 6:
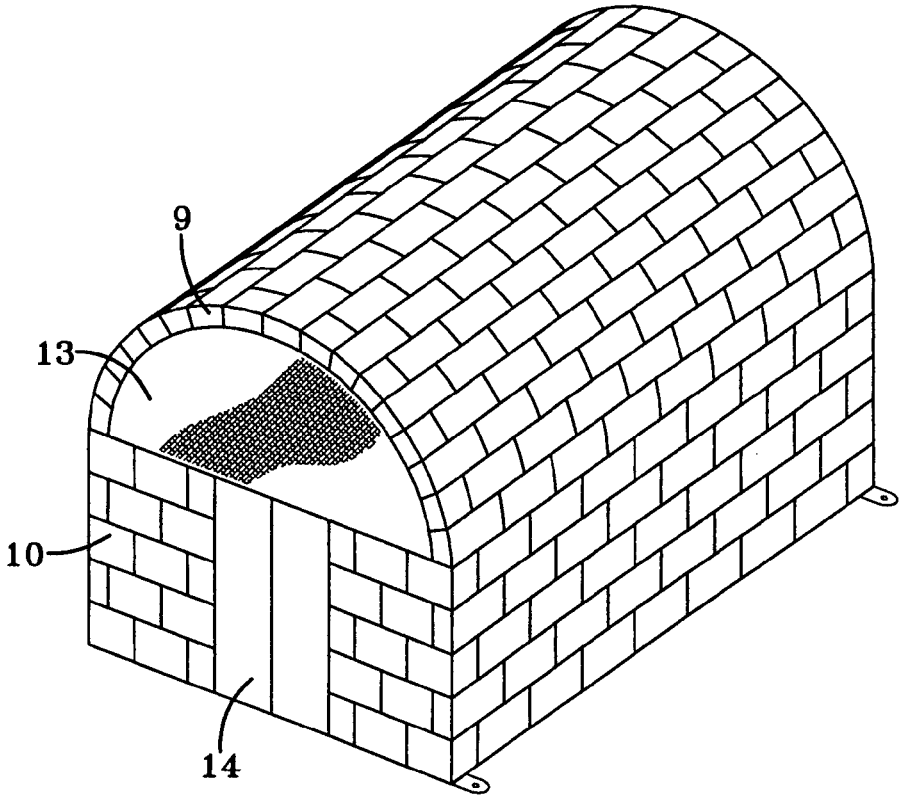
FIG. 6 is a perspective view of an inflatable building structure in accordance with an embodiment of this invention wherein the building has an arched roof.

The inflatable structures of this invention can be used advantageously in a variety of seasonable applications. For instance, they can be used during the winter months as a boat house and then deflated and removed in the spring after the boat is put back in the water for service. The ground on which the boat house was constructed is then available for alternative uses during the summer months. For instance the location where the inflatable structure stood can potentially be used as a garden. The inflatable structures of this invention can also be used as temporary and transportable hangars for aircraft or garages for automobiles, trucks, industrial equipment, and/or agricultural equipment. Campers and military personnel can also easily transport the inflatable structures of this invention to a desired location to provide temporary housing for people and/or equipment. Such an inflated structure is depicted in FIG. 6. The walls of this structure are comprised of rectangular cell members 10 and the roof of the structure is comprised of arched cell members 9. The area above the door 14 on the front of the structure is conveniently made of a flexible sheet 13 that is comprised of a flexible plastic or cloth, such as canvas. The door 14 is also conveniently made of a flexible plastic or cloth with ingress and egress being made available by opening and closing the door with a zipper.

Figure 5:
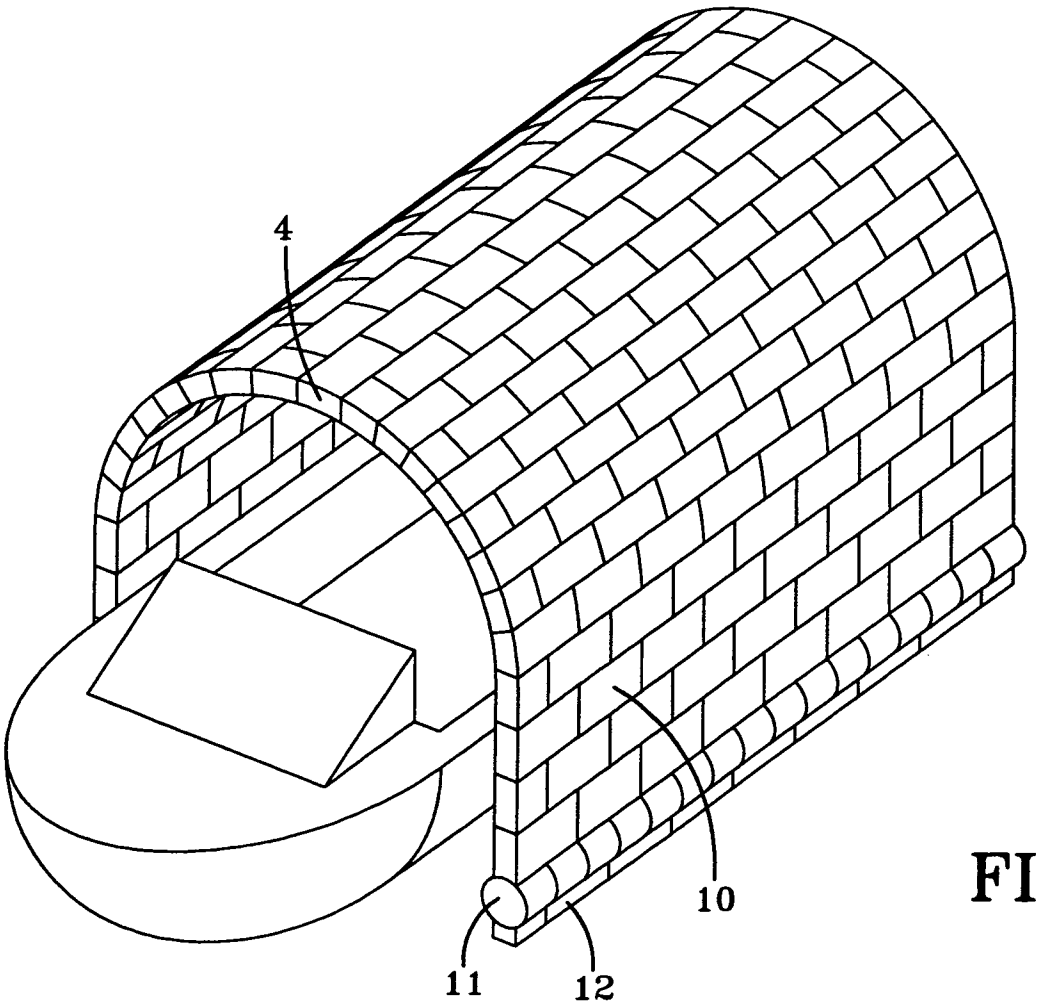
FIG. 5 is a perspective view of an inflatable floating boat house in accordance with an embodiment of this invention.

A floating boat house as shown in FIG. 5 can also be made in accordance with the present invention. Such a boat house has side walls that include rectangular block members 10 and has a roof that is comprised of arched cell members 9. The walls of the floating boat house are affixed to cell members that form an inflatable pontoon 11. To provide stability it is advantageous for ballast cell members 12 to be affixed to the bottom of the pontoon cell members. The ballast cell members will typically be inflated with a heavy material such as sand. Such floating boat houses can conveniently be used for seasonal or temporary boat storage.

Figure 7:
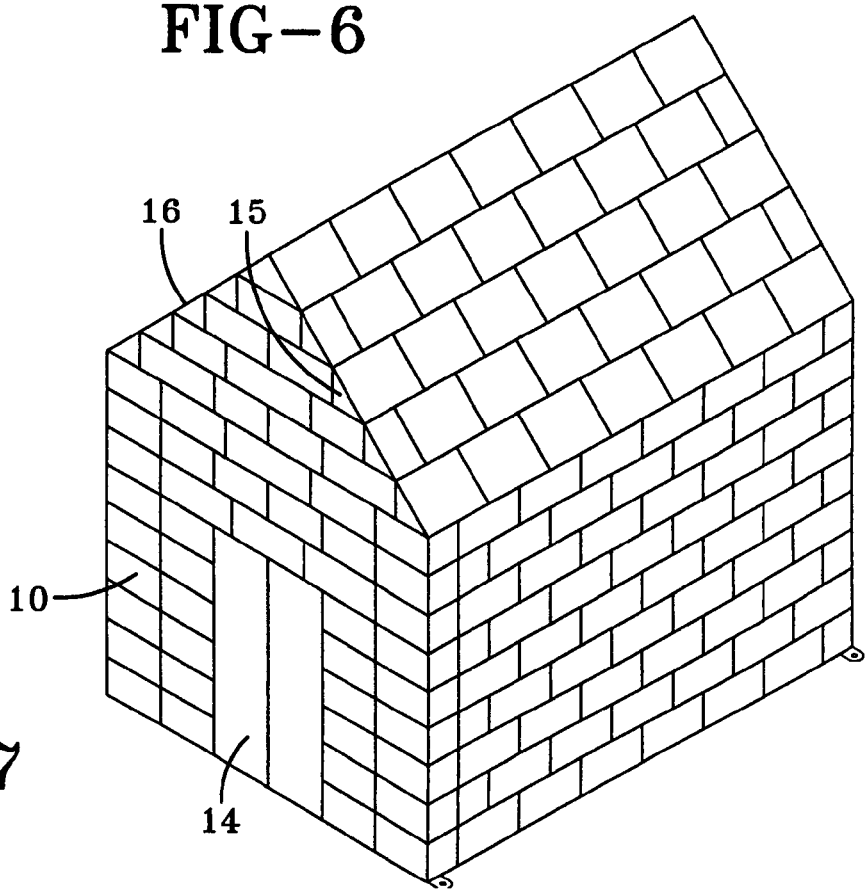
FIG. 7 is a perspective view of an inflatable building structure in accordance with an embodiment of this invention wherein the building has a sloped roof.
Figure 8:
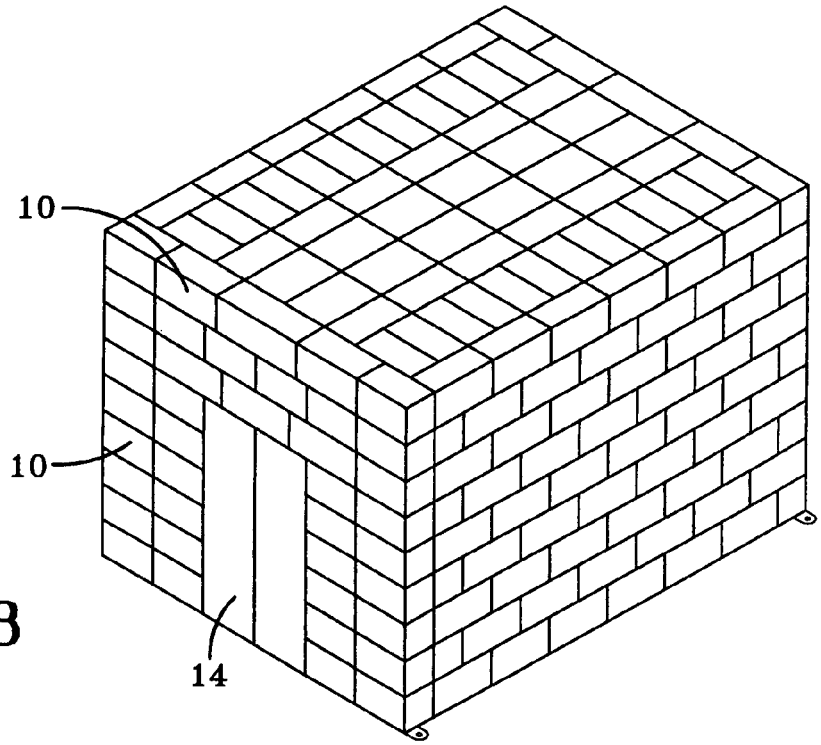
FIG. 8 is a perspective view of an inflatable building structure in accordance with an embodiment of this invention wherein the building has a flat roof.

FIG. 7 depicts an inflatable structure having a sloped roof. Its walls can be made utilizing rectangular cell members 10. The area above door 14 can also be constructed utilizing rectangular cell members 10. Rectangular cell members 15 can be utilized to form the sloped roof 16. A sloped roof typically offers the advantage of rain quickly flowing off of the roof structure due to gravitation force. However, inflatable structures of this invention can also be designed to have flat roofs as depicted in FIG. 8. The advantage to a structure having a flat roof is that it can be made solely from rectangular shaped cell members. Such flat roofed housing structures will typically include a door 14 which is comprised of a flexible material such as plastic or cloth with a zipper being included on the door structure to provide a means of ingress and egress.

Figure 9:
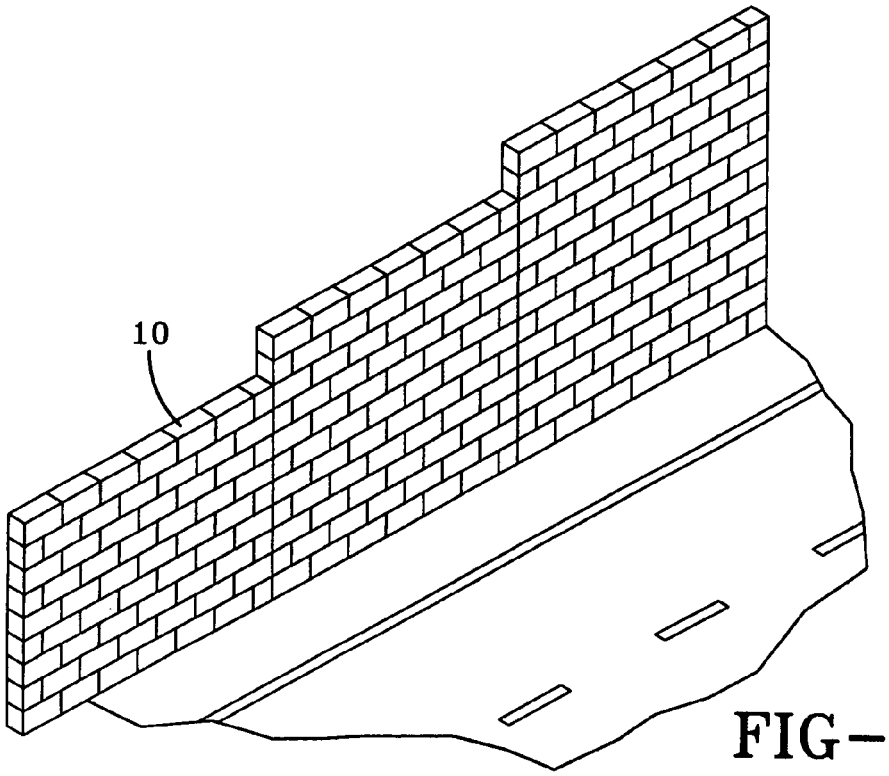
FIG. 9 is a front view of an inflatable highway sound barrier wall in accordance with an embodiment of this invention.

The technology of this invention can advantageously be utilized in making inflatable highway sound barrier walls. Such a highway sound barrier wall is depicted in FIG. 9. Such sound barrier walls are typically made utilizing rectangular cell members 10. The fluid utilized to inflate such highway sound barrier ways can be air, water, or a solid material such as sand or concrete. Since highway sound barrier walls are typically employed as relatively permanent structures it is generally advantageous to inflate the structure with concrete. In many cases it is desirable to use foamed concrete which has a density of only about ten percent of the density of convention concrete to fill the inflatable structure. This type of foamed concrete is sometimes referred to as light concrete. In cases where the structure is filled with concrete the orifices in the cell structures for inflation with the fluid are typically much larger than are the orifices which are used in cases where the structure will be filled with air or a liquid. In the case of highway sound barrier walls the orifices utilized used in the inflation of the structure will typically be oriented on the top surface of the cell members to facilitate pouring concrete into the cell members for inflation. The inflatable structures of this invention can also be designed to serve in the capacity of dams or levees for holding water. For instance, such inflatable levees can prove to be particularly advantageous in situations where a conventional levee has failed and it is critical to reconstruct a replacement levee very quickly. Since dams and levees need to be extremely strong, it is typically desirable to inflate such structures with convention high strength concrete.

Figure 10:
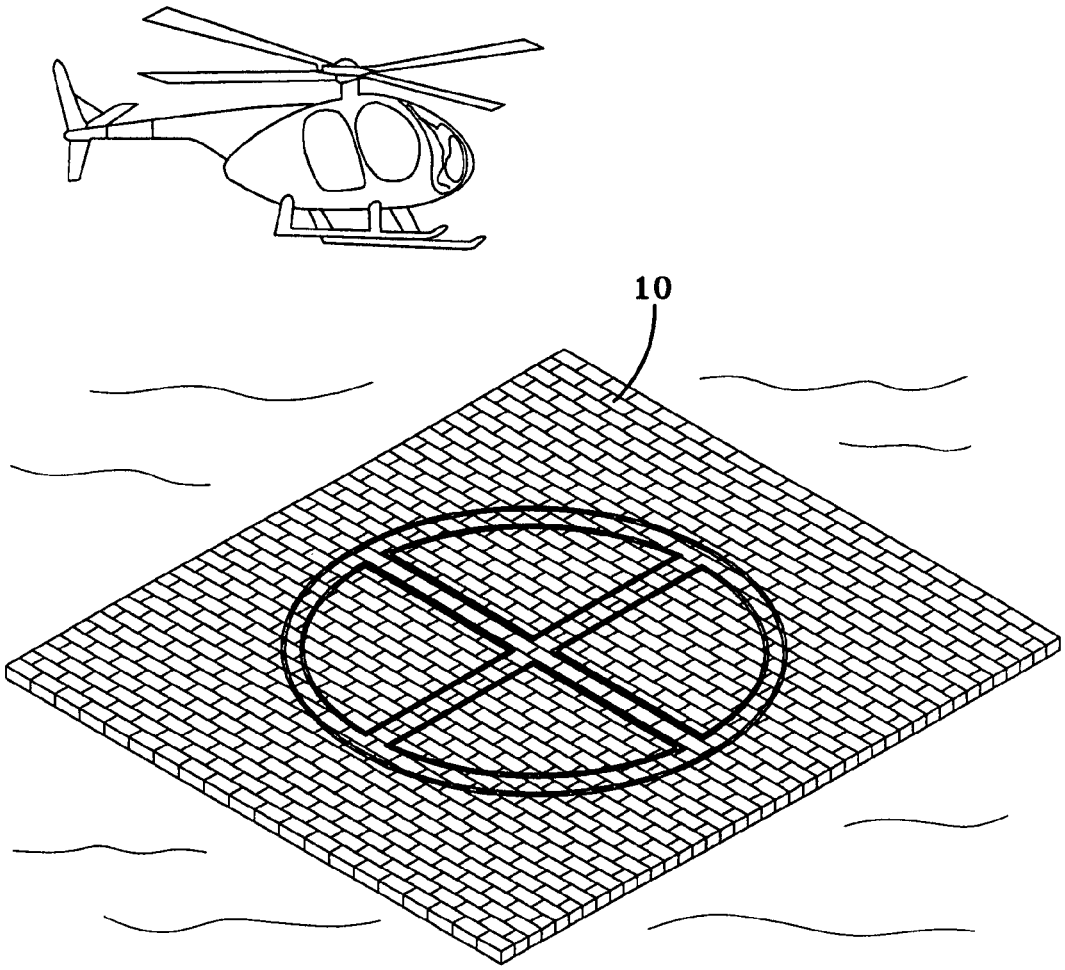
FIG. 10 is a perspective view of an inflatable helicopter landing pad in accordance with an embodiment of this invention

In some cases, such as military operations, it is desirable to quickly build a runway or heliport for aircraft on sandy or swampy soil and/or over bodies of water. FIG. 10 depicts a helicopter landing pad 10 which is comprised entirely of rectangular shaped inflatable cell members. Such inflatable helicopter landing pads or runways will be inflated utilizing a fluid that is suitable for the situation at hand. For instance, in cases where the runway is being constructed over solid land the material utilized to inflate the cell members can be heavier than water. On the other hand, in cases where the helicopter landing pad or runway extends over bodies of water it should typically be filled with a fluid that is lighter than water so that inflated runway will float. Concrete can be used inflate such structures over solid ground. However, concrete generally cannot be used to inflate the structure quickly even though it offers high strength. Another disadvantage of utilizing concrete in this application is that it normally takes a few days or even weeks to cure before being utilized. Thus, in cases where the runway must be constructed quickly, the fluid used to inflate the structure will typically be a gas, a liquid, or a chemical that quickly foams and cures to inflate the helicopter landing pad or runway.

Figure 11:
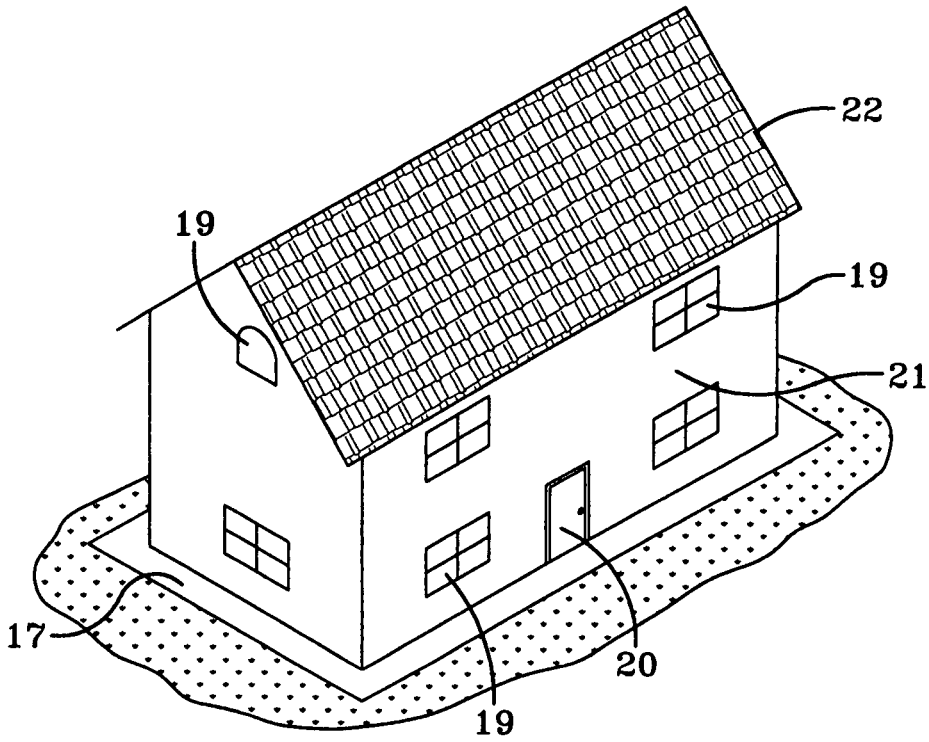
FIG. 11 is a perspective view of a conventional building structure.
Figure 12:
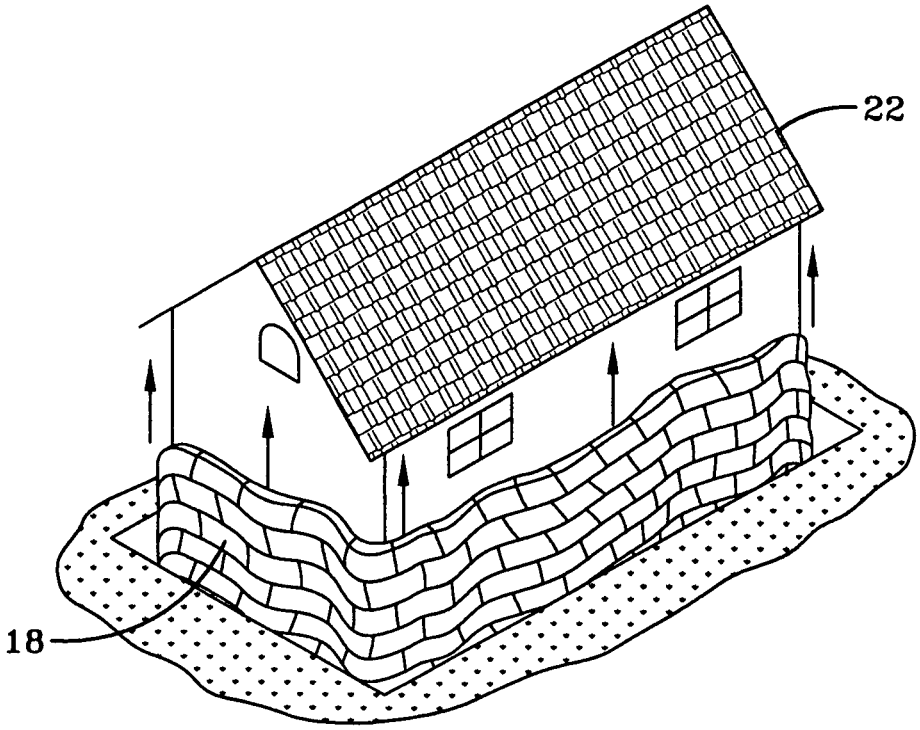
FIG. 12 is a perspective view of an inflatable protective barrier for a conventional building structure which is in the state of being inflated.
Figure 13:
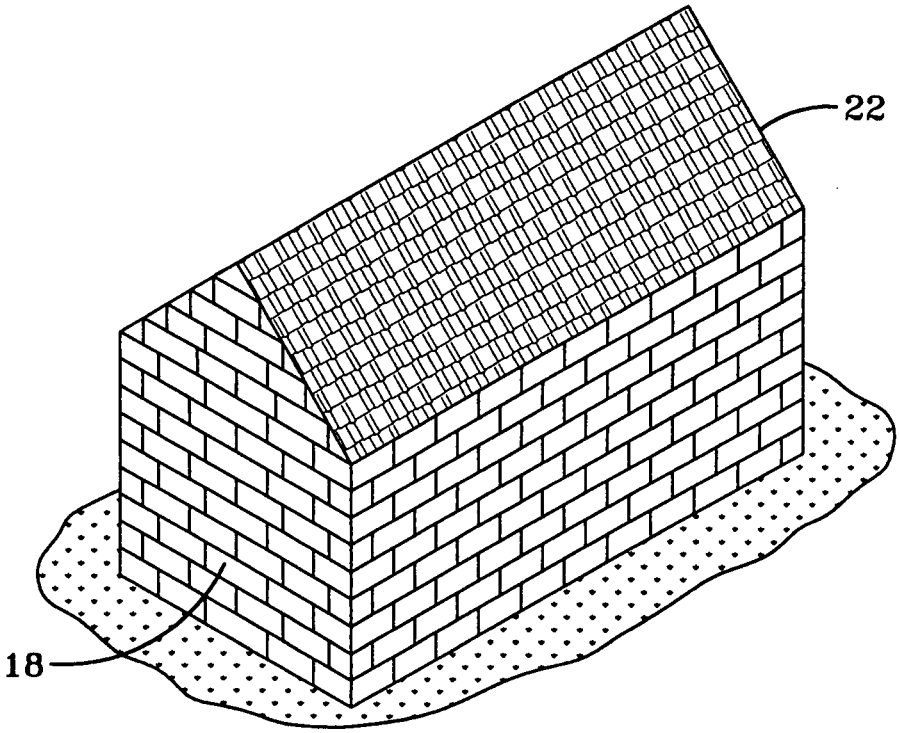
FIG. 13 is a perspective view of a conventional building structure that is protected with an inflatable building structure in accordance with an embodiment of this invention.

FIG. 11 depicts a conventional structure, such as a home or commercial building that is protected with an inflatable structure in accordance with this invention. In FIG. 11, the inflatable structure is in its uninflated state and concealed in a trough 17 which extends around the structure. The trough can optionally be designed to have a door on its upper surface which is closed while the inflatable structure is in its uninflated state and which opens to allow the inflatable protective structure 18 as illustrated in FIG. 12 to inflate to protect surfaces on the conventional building from damage during inclement weather conditions. For instance, the inflatable protective structure 18 can protect windows 19, doors 20, and siding or stucco surfaces 21 on the conventional structure from damage caused by blowing debris caused by high winds, tornadoes, or hurricanes. The inflatable structure in its inflated state can be designed to cover surfaces on the structure up to its roofline 22 as illustrated in FIG. 13. The inflatable protective structure is typically inflated by activating one or more air pumps which inflate the cell members of the structure. The inflatable structure will typically be inflated in advance of the inclement weather conditions and will be deflated after the high winds subside. In one highly preferred environment of the invention the structure is equipped with a wind gauge which will automatically inflate the protective structure at a preset wind velocity (such as 50 mph). Such a feature will act to protect the structure even if the homeowner or a business attendant is not at the site of the structure to manually inflate the protective structure before the arrival of dangerously high winds. FIG. 13 depicts the structure wherein the inflatable protective structure has been inflated to protect its windows, doors, and siding from blowing debris.

A high-altitude airship, an unmanned lighter-than-air vehicle that can be made with the inflatable cell members of this invention. Such a vehicle can operate above the jet stream in a quasi-geostationary position as a telecommunications relay or a surveillance platform for the observation of weather conditions or military operations. Lighter-than-air high-altitude airships offer the advantage of costing only a small fraction of the price of satellites. Light weight propulsion units are used to maintain such airships in their quasi-geostationary position. Such vehicles are generally powered by a photoelectric cell which is affixed to the inflatable cell members on the upper surface of the vehicle. The inflatable cell members of this invention generally cover the bulk of the remaining surfaces of the lighter-than-air vehicle except for control surfaces, antennas, satellite dishes, propulsion units, and the like.

In an alternative embodiment a single inflatable cell is used as a protective covering for conventional building windows. These protective coverings are useful in strong storms, tornadoes, and hurricanes to protect glass windows from high winds and flying debris. Such an inflatable protective window covering is light weight as well as quick and easy to install. Also, if inflated with a gas such as air, the protective covering is reusable and requires much less storage space than conventional window protection devices. FIGS. 14 to 19 illustrate the utilization of such protective window coverings in the protection of conventional windows on buildings.

Figure 15:
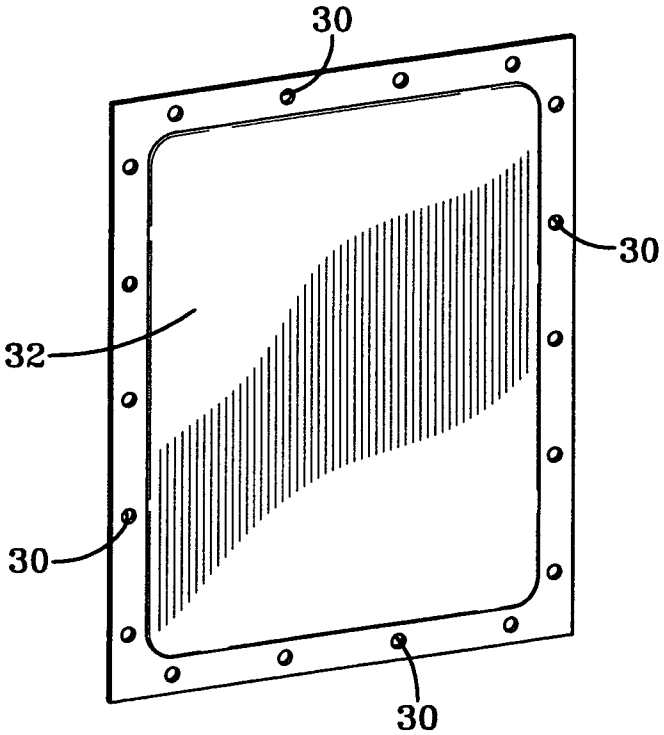
FIG. 15 is a front view of a protective window covering in accordance with an embodiment of this invention.
Figure 14:
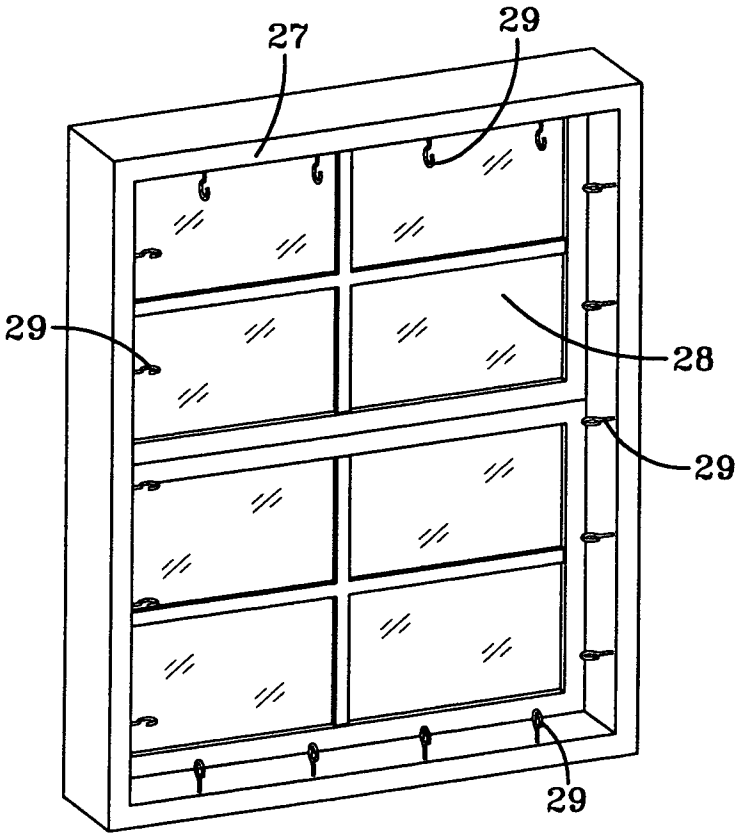
FIG. 14 is a front view of a conventional building window having hooks for attachment of protective window coverings in accordance with an embodiment of this invention affixed thereto.
Figure 17:
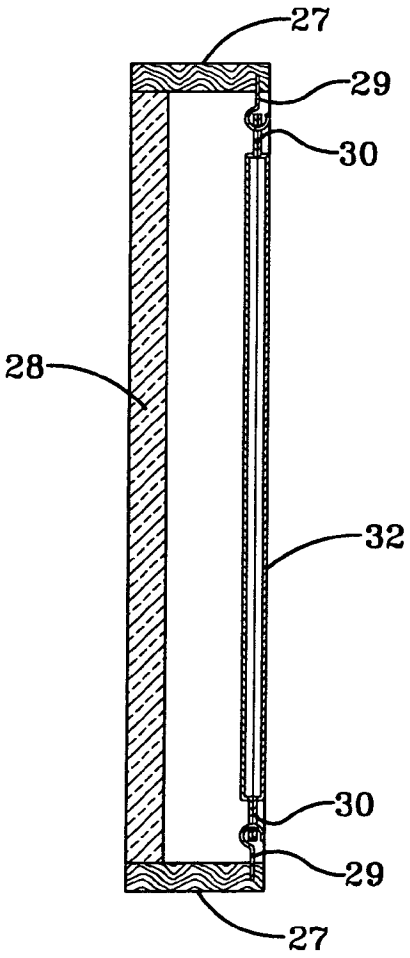
FIG. 17 is a side view of the protective window covering of FIG. 15 in an uninflated state wherein the protective window covering is attached to the conventional window of FIG. 14.
Figure 16:
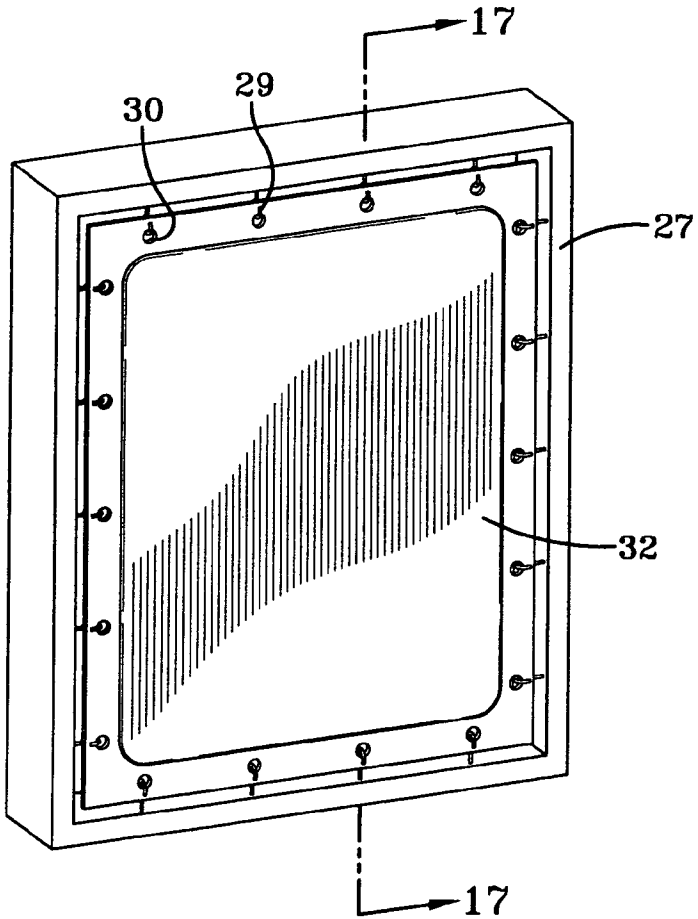
FIG. 16 is a perspective front view of the protective covering of FIG. 15 attached to the conventional window of FIG. 14 wherein the protective window covering is in an uninflated state.
Figure 19:
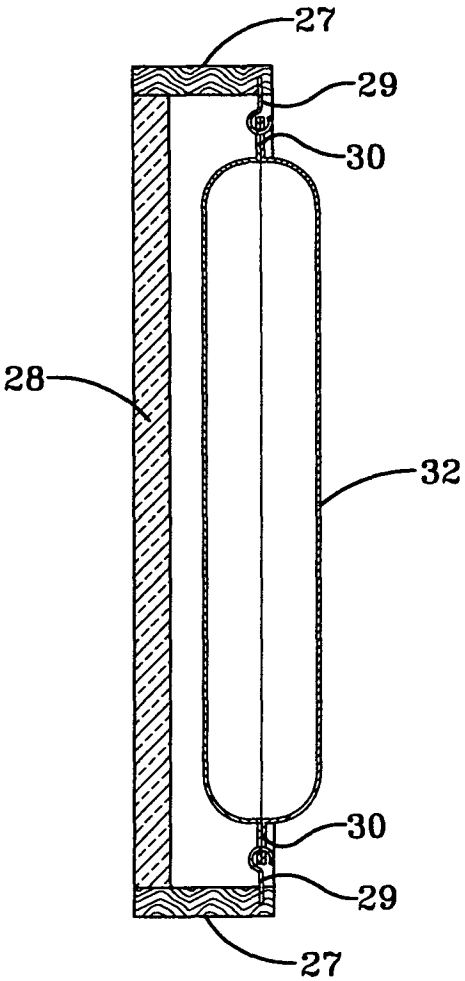
FIG. 19 is a perspective front view of the protective covering of FIG. 15 attached to the conventional window of FIG. 14 wherein the protective window covering is in an inflated state.
Figure 18:
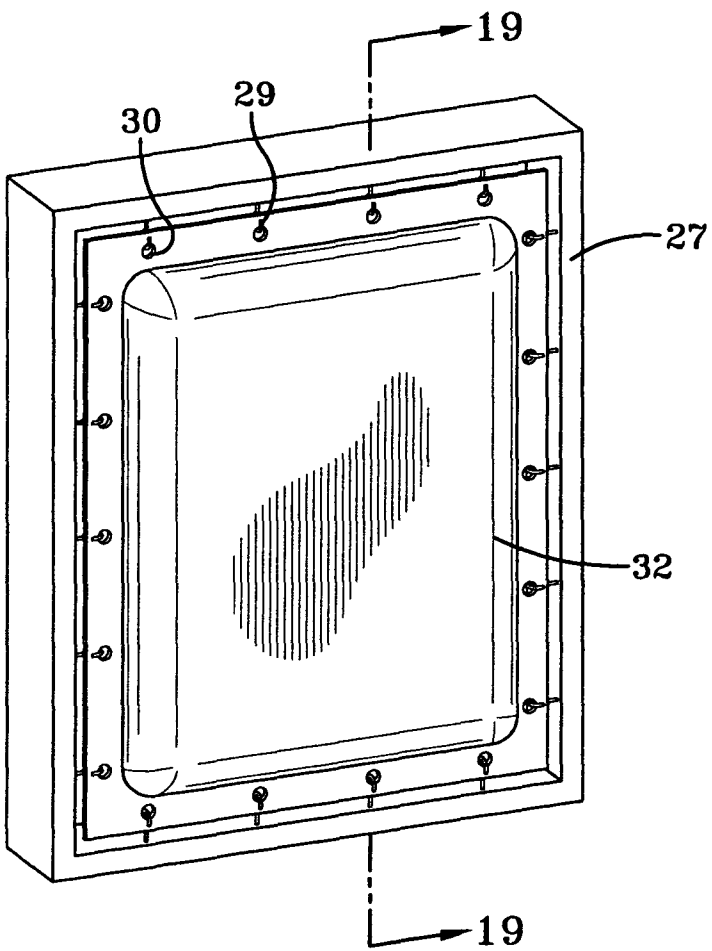
FIG. 18 is a perspective front view of the protective covering of FIG. 15 attached to the conventional window of FIG. 14 wherein the protective window covering is in an inflated state.

FIG. 14 shows a conventional building window 28 surrounded by a window frame 27. Multiple hooks 29 are mounted around the perimeter of the window frame. FIG. 15 shows the protective cover 32. Multiple eye hooks 30 are attached to the perimeter of the protective cover 32, each eye hook 30 corresponding to a hook 29 mounted onto the window frame. The protective covering 32 is secured to the window 28 by a securing means wherein tension created by inflating the protective covering at the inflation orifice 31 secures the protective covering to the window frame. When the window covering 32 is inflated, the shape of the covering changes due to the increase in thickness and this change in shape applies tension between the eye hooks 30 attached to the protective covering and the hooks 29 attached to the window frame 27. FIG. 16 and FIG. 17 illustrate the protective covering 32 placed over the window 28 in an uninflated state. FIG. 18 and FIG. 19 depicts the protective covering 32 after being inflated, and illustrates the change in shape that results from the inflation which creates tension in the hooks to firmly secure the protective window covering to the window frame.

In an alternative embodiment of this invention reinforcing strips running both horizontally and vertically through the protective window covering are implemented. These strips help to give the protective covering strength and also help to define the shape of the covering when inflated. The strips may be made of any flexible and strong material known in the art and suitable for such a purpose. The strips are disposed within the material of the protective covering and will typically be made of a metal. When the protective covering is in an uninflated state the reinforcing strips 33 allow the covering to maintain a relatively flat profile The protective covering of the present invention may be designed to fit over any size conventional building window. The means of securing the protective covering over the window may be any conventional means of attachment known in the art. Ideally, any parts used in securing the window covering to the building will be made of a corrosion resistant material so as not to become weakened after repetitive use and exposure to moisture.

While certain representative embodiments and details have been shown for the purpose of illustrating the subject invention, it will be apparent to those skilled in this art that various changes and modifications can be made therein without departing from the scope of the subject invention.

What is claimed is:

1. A protective window covering system comprising a conventional building window having a window frame and an inflatable protective window covering, wherein multiple hooks are mounted around the perimeter of the window frame, wherein the inflatable protective window covering is comprised of a single, uninterrupted inner cavity and walls wherein the walls of the protective covering enclose the inner space of the protective covering, and wherein the walls of the protective covering include at least two rows of fibers extending throughout at an angle that is offset by 15° to 75°, an inflation orifice wherein the inflation orifice operates to allow inflation of the protective covering with air, and a securing means wherein the securing means attaches loosely to the window frame in an uninflated state, wherein the inflatable protective covering does not include a support frame, wherein the security means includes multiple eye hooks are attached to the perimeter of the protective covering with the eye hooks being adapted to correspond to the hooks mounted on the window frame, and wherein inflation of the protective covering applies tension to the securing mechanism thereby securing the protective covering in position.

2. The inflatable protective covering system as specified in claim 1 wherein the protective covering is inflated with air.

3. The inflatable protective covering system as specified in claim 1 wherein the fibers extend through the walls at an angle that is offset by 40° to 50°.

4. The inflatable protective covering system as specified in claim 1 wherein the fibers are glass fibers or carbon fibers.

5. The inflatable protective covering system as specified in claim 1 wherein the fibers extend through the walls at an angle that is offset by 30° to 60°.

6. The inflatable protective covering system as specified in claim 1 wherein the protective covering is comprised of a plurality of cell members.

7. The inflatable protective covering system as specified in claim 6 wherein the plurality of cell members are affixed together by an adhesive.

8. The inflatable protective covering system as specified in claim 6 wherein the plurality of cell members are affixed together by stitching.

9. The inflatable protective covering system as specified in claim 6 wherein the at least one of the cell members includes a check valve and a deflation valve.

10. An inflatable protective covering as specified in claim 1 wherein the walls of the protective covering are comprised of multiple layers wherein at least one of the layers is comprised of a halobutyl rubber.

11. An inflatable protective covering as specified in claim 1 wherein the halobutyl rubber is selected from the group consisting of bromobutyl rubber and chlorobutyl rubber.

* * * * *